United States Patent [19]

Paton

[11] Patent Number: 4,596,194

[45] Date of Patent: Jun. 24, 1986

[54] YAW DAMPER FOR SWIVELABLE RAILCAR TRUCKS

[76] Inventor: H. Neil Paton, 2521 W. Montlake Pl. East, Seattle, Wash. 98112

[21] Appl. No.: 699,740

[22] Filed: Feb. 8, 1985

[51] Int. Cl.[4] ..... B61F 5/14; B61F 5/24

[52] U.S. Cl. ..... 105/199 CB; 105/182 R; 280/81 A; 384/423

[58] Field of Search ..... 105/157 R, 165, 167, 105/168, 182 R, 199 S, 199 CB, 218 A; 280/81 A, 86; 384/223, 423

[56] References Cited

U.S. PATENT DOCUMENTS

| | | | |
|---|---|---|---|
| 2,680,413 | 6/1954 | Becker | 105/199 CB X |
| 2,728,305 | 12/1955 | Candlin, Jr. | 105/454 |
| 3,518,948 | 7/1970 | King et al. | 105/199 CB |
| 3,687,085 | 8/1972 | Newman et al. | 105/171 |
| 3,690,271 | 9/1972 | Hobbs | 105/199 R |
| 3,693,553 | 9/1972 | Lich | 105/136 |
| 3,777,672 | 12/1973 | Schneider | 105/453 |
| 3,910,655 | 10/1975 | Willison et al. | 384/423 |

*Primary Examiner*—Randolph A. Reese

*Attorney, Agent, or Firm*—Finnegan, Henderson, Farabow, Garrett & Dunner

[57] ABSTRACT

The damper includes an elongated member that is movable conjointly with a swivelable railcar truck, and a yaw control assembly mountable by an overhead carbody. This assembly grips the elongated member so that a frictional damping force is applied to it when the truck negotiates curved track. In one embodiment, the damping force obtained remains substantially constant and, in another embodiment, it is proportional to load.

12 Claims, 7 Drawing Figures

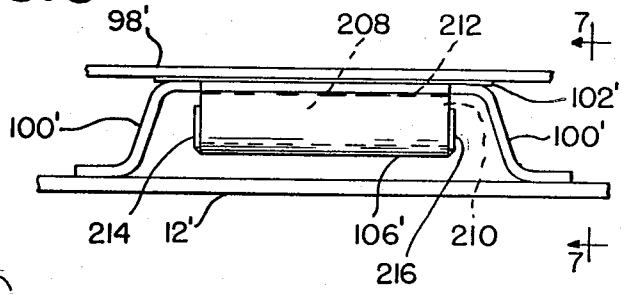
FIG. 6
FIG. 7
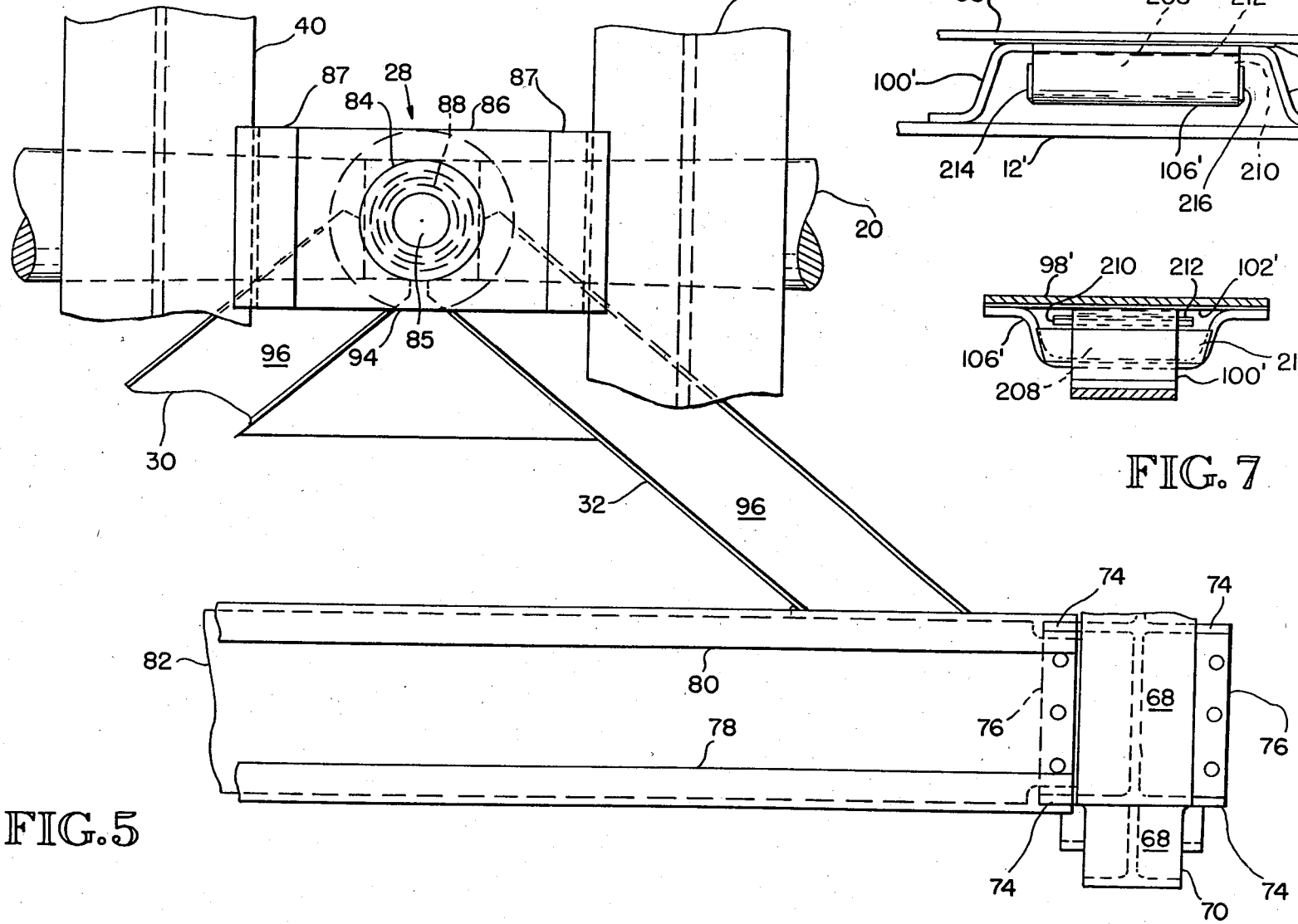
FIG. 5

YAW DAMPER FOR SWIVELABLE RAILCAR TRUCKS

BACKGROUND OF THE INVENTION

This invention relates to railcars and, more particularly, to dampers suitable for use to control yaw in swivelable railcar trucks. The invention is illustrated and described herein for application to swivelable single axle railcar trucks; however, the invention is not limited to this application and may be used with double axle, triple axle and other types of swivelable trucks or bogies.

A principal object of this invention is to provide an improved yaw damper for a swivelable railcar truck, whether single axle, double axle, triple axle or other construction.

Another object of this invention is to provide a yaw damper for a swivelable railcar truck that applies frictional damping force when the truck negotiates curved track.

A related object of this invention is to control the frictional damping force obtained so that it can provide multiple truck control functions.

Still another object of this invention is to provide a yaw damper especially suited for use with the swivelable single axle railcar truck disclosed herein.

SUMMARY OF THE INVENTION

These objects are accomplished in accordance with the principles of this invention by providing a yaw damper that comprises an elongated member or other means movable conjointly with a swivelable railcar truck. This member forms general direction of straight line truck travel. A yaw control assembly mountable by an overhead carbody compressively grips these surfaces to apply a frictional damping force to at least one of these surfaces as they move away from the general direction of straight line truck travel when the truck negotiates curved track. According to further aspects of this invention, the yaw control assembly includes a yaw damper that provides either a damping force or both a damping force and a self-centering force in response to such movement of the truck.

These and other features, objects and advantages of the present invention will become apparent from the detailed description and claims to follow, taken in conjuction with accompanying drawings in which like parts bear like reference numerals.

BRIEF DESCRIPTION OF THE DRAWINGS

FIG. 5 is a section taken along the line 5—5 in FIG. 3;

FIG. 6 is a side elevation of another presently preferred embodiment of the yaw damper of this invention;

FIG. 7 is a section taken along the line 7—7 in FIG. 6.

DETAILED DESCRIPTION OF THE DRAWINGS

Figure 1:
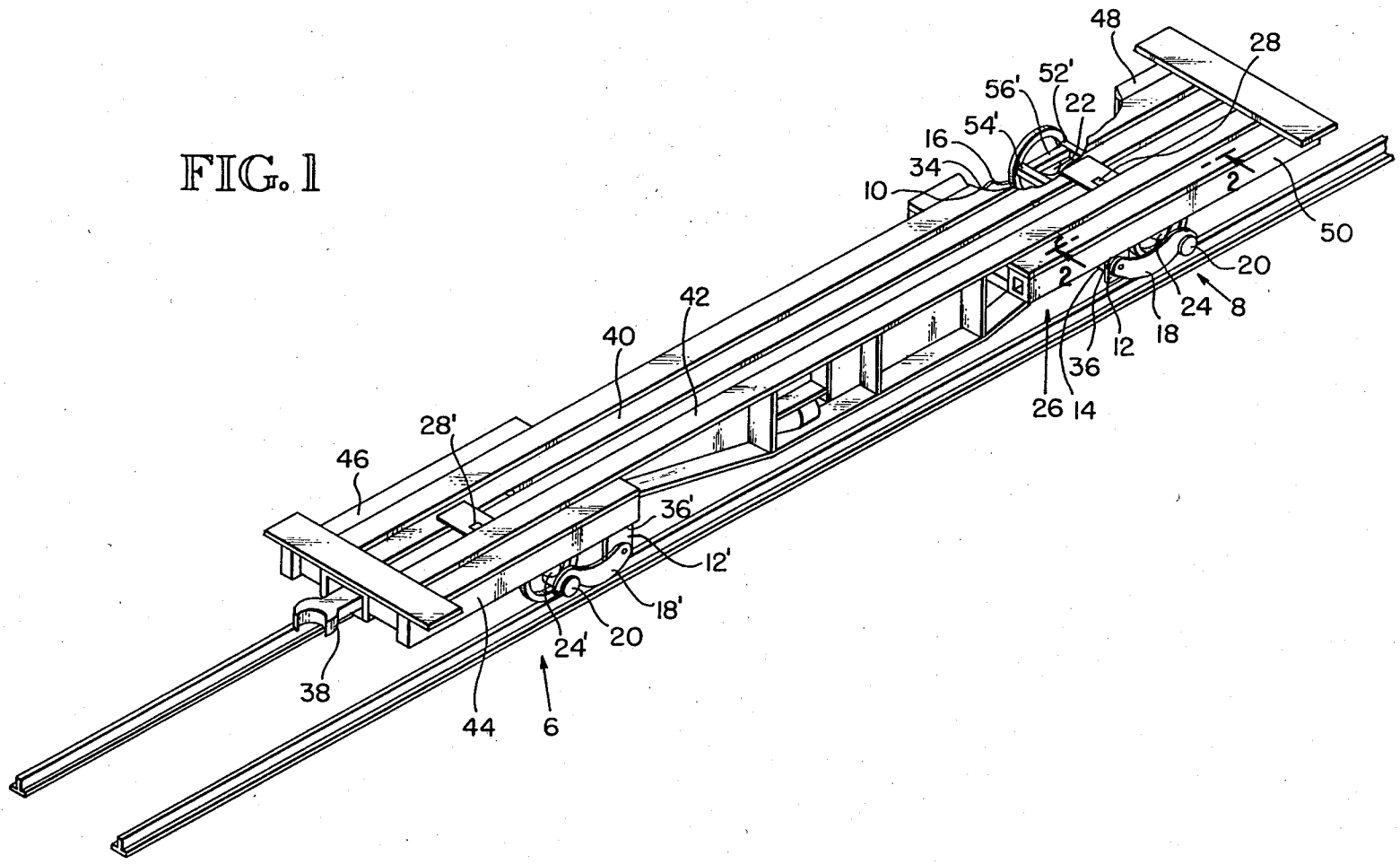
FIG. 1 is a perspective of a railcar equipped with two swivelable single axle railcar trucks, each including two of the presently preferred yaw dampers according to this invention, with part of the railcar body broken away.

One presently preferred embodiment of the yaw damper of this invention is particularly suited for, but not limited to, use in the swivelable single axle railcar truck and railcar illustrated in FIG. 1, in which two such trucks (generally referenced by numerals 6 and 8) are used. Truck 6 is identical to truck 8 except that it faces the opposite direction, as shown (FIG. 1). Accordingly, for sake of brevity, only truck 8 is illustrated and described in detail, with parts of truck 6 corresponding to those of truck 8 being designated by the same reference numerals, primed.

As illustrated in FIG. 1, truck 8 comprises two parallel damper ramp supports 10 and 12 that are connected together by a transverse tie assembly 14. Two independently movable radius arms 16 and 18 are respectively pivoted from the damper ramp supports for supporting a single wheeled axle 20 spaced from and in parallel alignment with assembly 14. Two spring elements 22 and 24 respectively act between the radius arms 16 and 18, and an overhead railcar body (generally referenced by numeral 26) so as to independently spring the radius arms from and provide vertical load bearing support with respect to body 26. A swivel assembly 28 is supported by two convergent beams 30 and 32 (FIG. 5) from assembly 14 in overlying relation to axle 20 at two spaced apart vertical load support points adjacent the ends of axle 20. The swivel assembly provides horizontal load bearing support with respect to body 26 and a vertical rotational axis about which truck 8 can move rotatively when negotiating curved track. In the example illustrated, this rotational truck axis intersects axle 20. Two yaw control assemblies 34 and 36 respectively act between damper ramp supports 10 and 12 and body 26 for controlling horizontal shifting of the damper ramp supports with respect to body 26 in response to rotative movement of truck about the rotational truck axis when negoiating curved track.

In the example illustrated in FIG. 1, the railcar is particularly suited for, but is not limited to, use as a container-on-flatcar (COFC) or a trailer-on-flatcar (TOFC) designed to carry either a single container or a single trailer between 45 and 50 feet in length. Several such railcars may be formulated into multi-unit trains in which they are articulated together, or may be connected by conventional couplers and employed as single unit railway cars. In the example illustrated, the railcar is or may be suited for either usage, although it is depicted as having a conventional coupler 38 at the end supported by truck 6. Body 26 is made up of two parallel, closely spaced apart I-beams 40 and 42 that extend substantially its entire length, and respectively support outboard deck sections 44, 46, 48 and 50 adjacent their ends.

Figure 2:
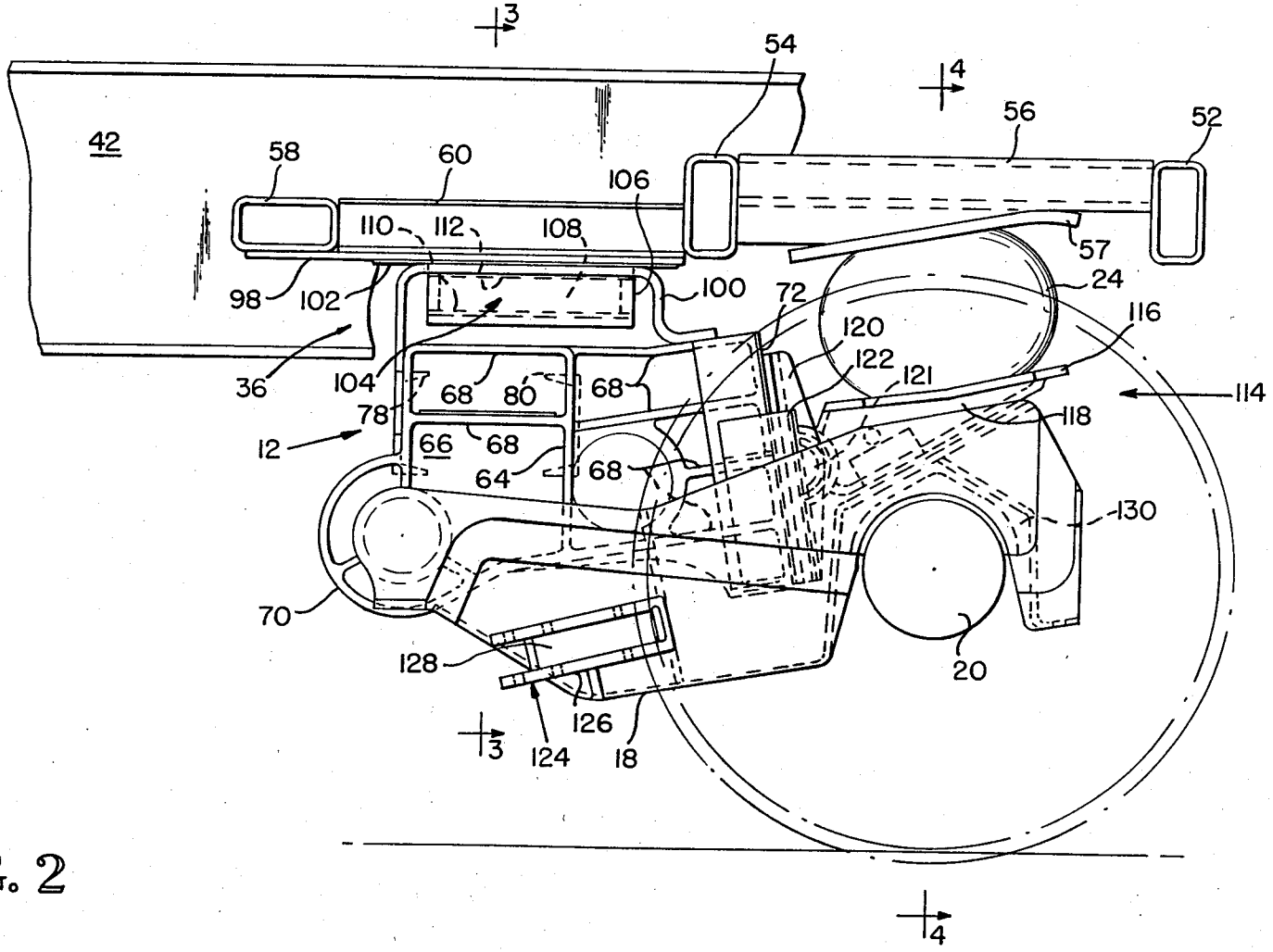
FIG. 2 is a section taken along the line 2—2 in FIG. 1.
Figure 3:
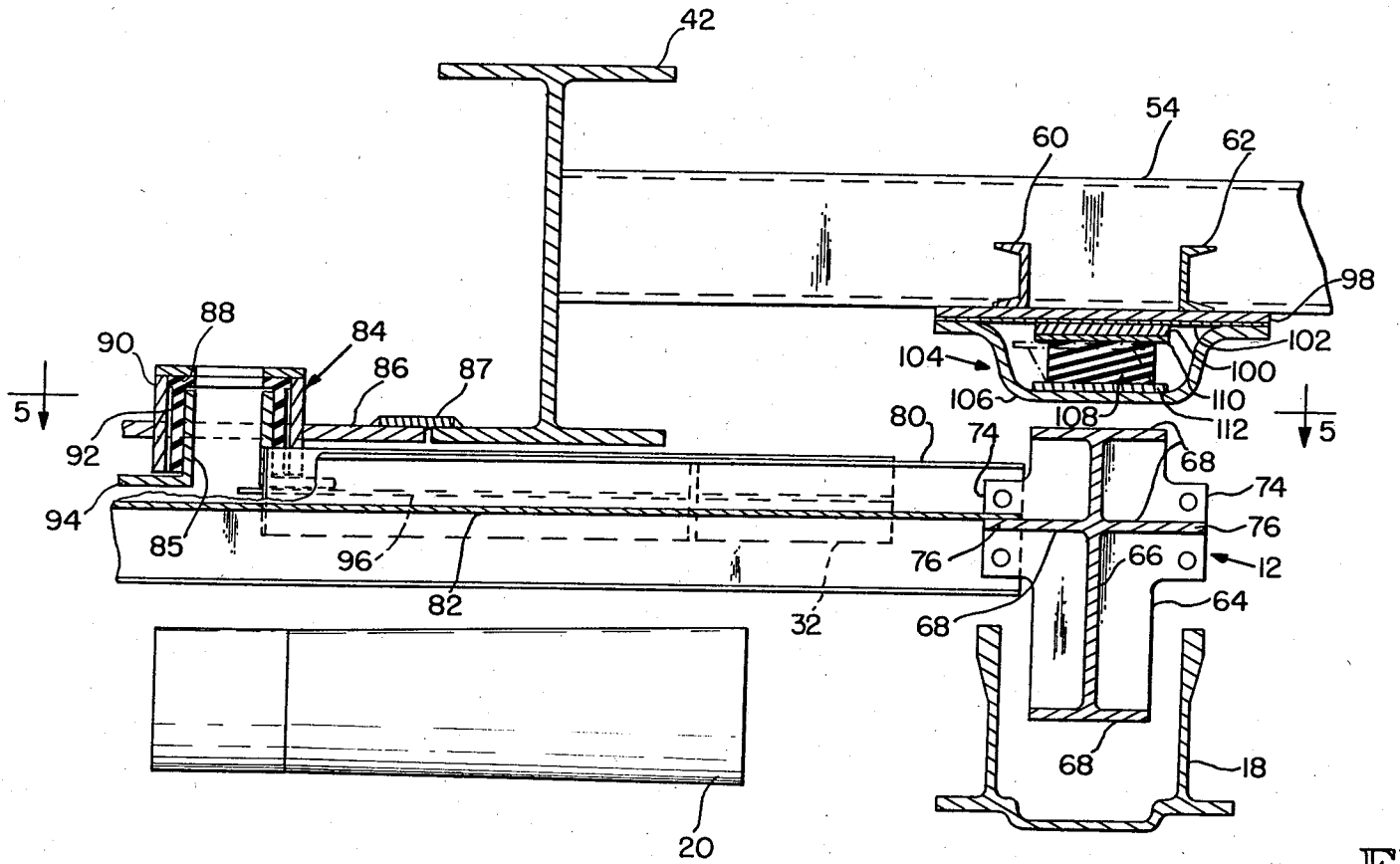
FIG. 3 is a section taken along the line 3—3 in FIG. 2.
Figure 4:
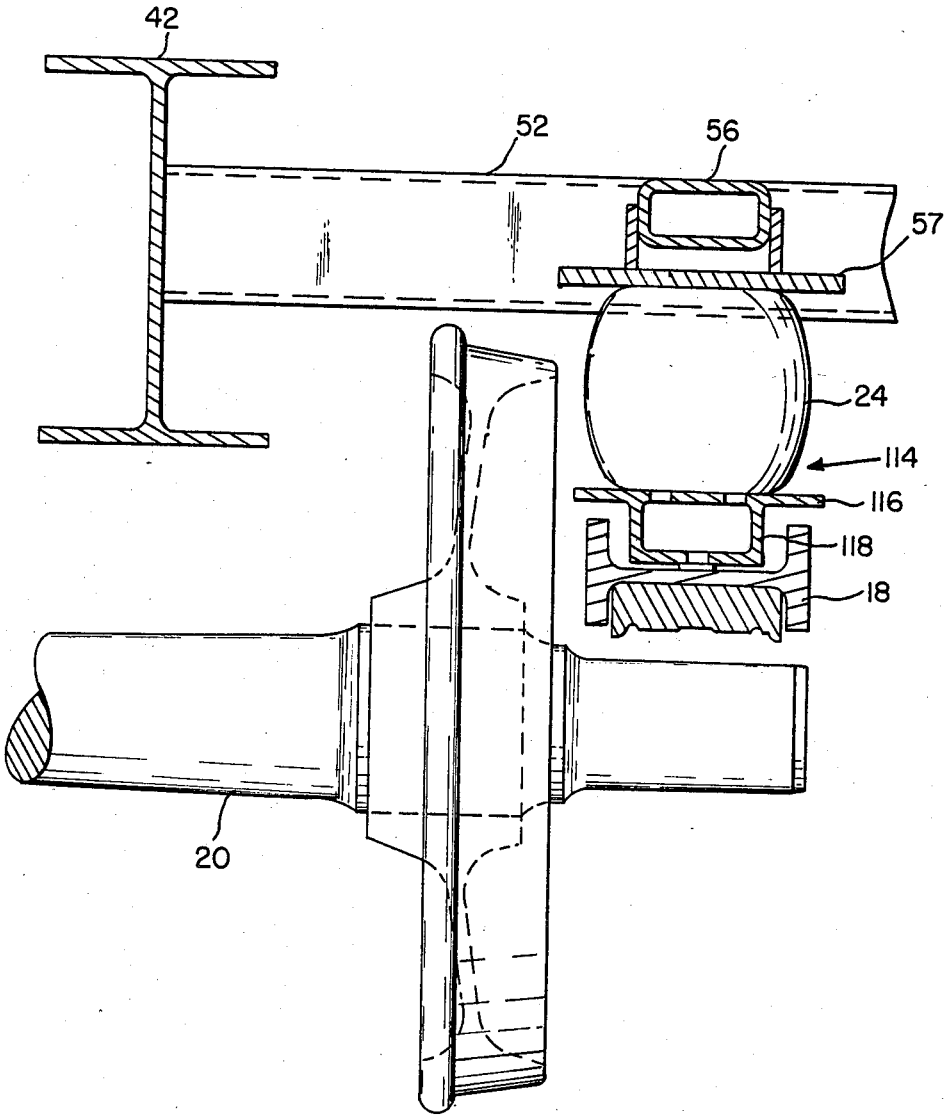
FIG. 4 is a section taken along the line 4—4 in FIG. 2.

Each of these deck sections is identical. Accordingly, for sake of brevity, only section 50 is shown in detail and described with reference numerals; however, corresponding parts of section 48, to the extent illustrated in FIG. 1, are designated by the same reference numerals, primed. Referring now to FIGS. 2-4, the portion of section 50 that overlies the outboard end of axle 20 is reinforced by two box beams 52 and 54 that project perpendicularly from I-beam 42 in an outboard direction. These beams are parallel to, but are spaced apart over, opposite sides of axle 20 so that they generally straddle axle 20 when in its centered position illustrated. Another box beam 56 extends between and is supported by beams 52 and 54 generally in overlying alignment with radius arm 18. A spring platen 57 is secured to and underlies beam 56, as shown (FIG. 4). This provides reinforcement for the transmission of vertical loads between body 26 and spring element 24, as will be described presently. Spaced from this reinforced portion, the carbody is further reinforced, but to a lesser degree, for operation with assembly 36. This reinforcement is provided by a box beam 58 that projects from I-beam 42, along with two L-beams 60 and 62 that extend between and are supported by beams 58 and 54. Beams 60 and 62 are parallel to and generally spaced apart above the sides of the damper ramp support 12, as shown (FIG. 3).

Referring now in particular to truck 8, damper ramp supports 10 and 12 are identical. Accordingly, for sake of brevity, only damper ramp support 12 is shown in detail and described with reference numerals. Damper ramp support 12 may be of cast or welded construction. In the example, it is of cast construction and is made up of a web reinforced body 64 having a center institutional web 66 and multiple transverse webs 68 of both horizontal and vertical dispositions. One end of body 64 forms a web-reinforced journal portion 70 that provides the pivotal support for radius arm 18. The other end of body 64 forms a friction surface 72 (FIG. 2) of suitable composition. This surface cooperates with a damping element carried by radius arm 18 to damp movement of radius arm 18, as will be described presently. Body 64 further includes four transversely projecting vertical tabs 74 and two transversly projecting horizontal tabs 76 that extend the length of the body, each of which projects from one of the webs 66, 68. These tabs are symmetrically disposed so that the same body casting can be used either for damper ramp support 10 or damper ramp support 12.

The transverse tie assembly 14 is made up of two spaced apart, parallel C-beams 78 and 80 that open toward one another. In the example, these beams are secured at their ends to tabs 74 and identical tabs not shown formed by damper ramp support 10. Assembly 14 further includes an elongated strip-like member 82 that extends between beams 78 and 80 and is secured at its ends to tabs 76 and identical tabs not shown formed by damper ramp support 10. This member provides torsional stiffness to assembly 14 that resists rotative shifting of the damper ramp support 10 and 12 about a transverse axis through it. The amount of this stiffness should be sufficient to permit the damper ramp support to shift somewhat about this axis in respective vertical planes in order to accomodate the effects of irregularities in track joints, track spacing and other track conditions that may affect the dynamic behavior of the truck.

The swivel assembly 28 acts between the convergent ends of beams 30 and 32 and I-beams 40 and 42. Referring to FIGS. 3 and 5, assembly 28 includes a center bowl 84 and a king pin 85. Center bowl 84 is mounted by a flange 86 between the inboard flanges of I-beams 40 and 42 by welded lap joints 87. Center bowl 84 includes an elastomeric spring ring 88 that is force fit within a cylindrical housing 90 by a shim 92. Flange 86 projects transversely from the exterior of housing 90. King pin 85 includes a lower annular flange 94 that is secured to center webs 96 of both beams 40 and 42, as shown (FIG. 3). King pin 85 projects upwardly from flange 94 and extends coaxially into and through spring ring 88, with which it is engaged by the force produced by shim 92.

Consequently, the truck is rotatively moveable about a vertical axis of rotation through the king pin. Such movement is resisted, however, by resilient shear forces set up within spring ring 88 in proportion to the extent of the rotational deflection obtained. Spring ring 88 thus acts as a source of self-centering force that tends to urge the truck toward a central position corresponding that normally encountered when the truck is traversing straight track. This self-centering force is controllable by appropriate selection of the construction of the spring ring. In one presently preferred embodiment of the present invention, however, additional self-centering force is desired, so the truck is equipped with yaw dampers to be described presently. As will be recognized, of course, this may or may not be desireable in all applications, in which a conventional non-sprung swivel assembly could be used in place of swivel assembly 28. In this case, the self-centering force, if any, could be provided by any, some or all of the foregoing, or otherwise.

In one presently preferred embodiment of the swivelable single axle truck of this invention, each of the yaw control assemblies 34 and 36 includes a yaw damper that provides both frictional damping and self-centering forces. An important aspect of this presently preferred yaw damper is that the frictional damping force obtained remain substantially constant, instead of variable, in response to variations in applied load on the associated yaw control assembly when the truck negotiates curved track. Unlike prior single axle trucks, therefore, the effects of rail induced wheel creep forces influence on truck rotation are controllable so that undesireable truck oscillations or "hunting" are minimized or substantially eliminated. Another advantage of this yaw damper is that it provides viscous damping of such oscillations. Inasmuch as vertical load support is provided at spring elements 22 and 24, the vertical load on assemblies 34 and 36 is relatively small as compared to the full weight of carbody 26. As a consequence, assemblies 34 and 36 allow relative sliding movement between parts mounted by the carbody 26 and truck 8, as will now be described.

The yaw control assemblies 34 and 36 are identical. Accordingly, for sake of brevity, only assembly 36 is shown in detail and described with reference numerals. Referring now in particular to FIGS. 2 and 3, assembly 36 comprises an elongated member 100 forming an upper planar surface and a lower planar surface, both extending in horizontal parallel alignment with the general direction of straight line truck travel. Assembly 36 further includes a fixed upper member 98 that is mounted by body 26 in sliding load transmitting relation with the upper surface of member 100, and a lower yaw damper (generally referred by numeral 104) also mounted by body 26. The upper and lower surfaces of member 100 are compressively gripped between member 98 and yaw damper 104 such that a frictional damping force is applied to at least one of these surfaces, preferably the lower one, as they move away from the general direction of straight line truck travel when the truck negotiates curved track.

Member 98 is mounted by the carbody 26 beneath the reinforced portion bounded by beams 60 and 62, generally in overlying relation with damper ramp support 12. This member forms a planar surface 102 having a low coefficient of static friction and a relatively higher coefficient of dynamic friction, preferably twice the coefficient of static friction. This surface slidably bears down upon the upper surface of member 100. Member 100 is formed as an elongated strip-like member of generally inverted U-shaped configuration. As most clearly show in FIG. 2, member 100 is secured at one end to the upper face of damper ramp support 12, and at its other end to the end of damper ramp support 12 adjacent portion 70, so that it extends essentially along the length of damper ramp support 12. The upper and lower surfaces at member 100 extend in parallel alignment with the length at damper ramp support 12, and hence with the general direction of straight line truck travel when the truck negotiates straight track. The lower surface of member 100 slidably bears down upon yaw damper 104.

Still referring to FIGS. 2 and 3, yaw damper 104 is made up of channel member 106 and a shear/compression spring 108. Member 106 is transverse to and underlies member 100, and is secured at its ends by spot welds or the like to the carbody 26, as shown (FIG. 3). Member 106 includes a depressed midsection that supports spring 108 so that it is precompressed a predetermined amount against the lower surface of member 100. In the example, spring 108 includes two bonded end plates 110 and 112 that respectively bear against the lower surface of member 100 and the midsection of member 106, as shown (FIG. 3). Member 100 therefore is supported on spring 108 and is effectively gripped between spring 108 and surface 102 in response to the compression force set up in spring 108. As a consequence, the frictional damping force obtained is proportional to the resultant of the downward force applied by carbody 26 at surface 102 and the upward normal force exerted by spring 108 against the lower surface of member 100.

An important aspect of yaw damper 104 is that this force is controllable in relation to the deflection of spring 108 caused by shifting of member 100 away from the neutral or center position it normally occupies when the truck is in straight line travel. Unlike conventional load responsive yaw dampers, it is possible to control this force so that the frictional damping force obtained remains substantially constant under these conditions. This is accomplished by causing spring 108 to be deflected transversely in shear, as depicted in broken lines in FIG. 3, in response to shifting of member 100 as the truck negotiates a track section having a curvature that tends to cause increased force loading on yaw damper 104. In the example illustrated in FIG. 3, spring 108 is depicted in shear on exaggerated scale for clarity, as it would appear when truck 8 negotiates a track section that curves to the left, with truck 8 the lead truck. As it is thus deflected, spring 108 tends to thin down and therefore exerts less compression force upon the lower surface of member 100. During this time, however, the cornering conditions experienced by the truck are such that the downward force appearing at surface 102 has increased. By selecting an appropriate spring construction, this reduction in spring force offsets the increase in downward force so that the frictional damping force obtained remains substantially constant, both during and after the time the truck negotiates the curved track section. As will be appreciated, similar but oppositely acting effects are obtained when the cornering conditions produce a decrease in downward force at surface 102.

Thus it is possible, by appropriate selection of spring construction, to control the occurance of this "thinning" effect in relation to shifting of member 100 so that the frictional damping force obtained remains substantially constant throughout the range of truck rotation, regardless of loading conditions. As will now be appreciated, once spring 100 is so deflected, it continuously applies a shear restoring force, seeking to return to its normal condition of essentially sole compression deflection illustrated in solid lines in FIG. 3. This of course produces a force on the lower surface of force member 100 that urges the truck back to a normally centered position. It will be recognized, of course, that conventional yaw dampers or centering devices could be used in place of or in addition to swivel assembly 28 and yaw control assemblies 34 and 36; however, to the extent these introduce load sensitivities in the damping forces obtained, performance of the truck may be degraded from that attainable with the presently preferred construction. Likewise, yaw control assemblies 34 and 36 could act as guides only, guiding the truck as it swivels without application of any frictional damping force. In this instance, of course, spring 100 could be eliminated or its effects limited to providing requisite support for member 100.

In those instances where sufficient self-centering force is obtained from the swivel assembly or otherwise, and where it is not a requirement to provide substantially constant frictional damping forces as just described, the yaw damper illustrated in FIGS. 6 and 7 may be used in place of yaw damper 104 to provide load proportional frictional damping. This yaw damper is generally similar to yaw damper 104, except that the elastomeric spring is not deflected in shear and hence neither thins down nor exerts a self-centering force. Parts of the FIGS. 6 and 7 yaw damper corresponding to those of yaw damper 104 are not described further, but are designated by the same reference numerals, primed.

Still referring to FIGS. 6 and 7, channel member 106' supports an elastomeric compression spring 208 which, like spring 108, is precompressed and exerts a predetermined normal force against the lower surface of member 100'. Unlike yaw damper 104, however, a plate 210 is interposed between spring 208 and member 100'. Plate 210 is not secured to spring 208. This plate includes a low friction surface 212 identical to surface 102 that is in face-to-face contact with the lower surface of member 100. Plate 210 therefore is free to shift with respect to member 100 and likewise permits member 100 to shift with respect to spring 208. To the extent stick-slip or like conditions at surface 212 produce transverse forces in response to shifting of member 100', some conjoint movement of plate 210 may occur, with attendant shear forces being transmitted to spring 208. These forces, however, should be small in magnitude as compared to those set up in spring 108, and should be dissipated by subsequent shifting of plate 210 developed on account of its being allowed to "float" with respect to spring 208. Consequently, spring 208 is subjected essentially only to compressive loads, and hence the frictional damping force obtained may vary in proportion to such loads, with little, if any, of the effects of shear loading/deflection attainable with yaw damper 104. End plates 214 and 216 enclose the ends of member 106' to maintain spring 208 in a fixed position within the channel. An advantage of the FIGS. 6 and 7 yaw damper and yaw damper 104 is that both are self compensating for wear in that, as their respective friction surfaces are worn away, the elastomeric spring continually urges the friction surfaces into frictional engagement.

In the example illustrated, the swivelable single axle truck of this invention includes two independently damped suspension assemblies that are respectively operable with radius arms 16 and 18. These suspension assemblies are identical and, as in the case of the other identical assemblies described previously, only one, the suspension assembly associated with radius arm 18 (generally referenced in FIGS. 2 and 4 by numeral 114) is shown in detail and described with reference numerals. As most clearly illustrated in FIGS. 2 and 4, spring element 24 is in the form of an elastomeric rod spring that is compressable transversely between upper platen 57 described previously, and a lower platen 116 formed by a force resolving wedge 118. This wedge is carried by the end of radius arm 18 in overlying relation to the end of the axle, and is movable within a guide channel formed by the radius arm for movement toward and perpendicular to surface 72 in response to application of a force normal to surface 72. A frictional damper 120 is supported by pivot 121 from the thick end of wedge 118, by which it is urged in a normal direction against surface 72. Two guide plates 122 are respectively upstanding from the sides of surface 72 to engage and maintain damper 120 in alignment with surface 72 as the end of radius arm 18 pivots vertically. In operation, as the radius arm pivots vertically, wedge 118 resolves a component of the compressive force on spring element 24 into a normal force urging damper 120 into engagement with surface 72. As will be appreciated, the frictional damping force obtained will vary in accordance with this normal force and therefore is proportional to the vertical load applied to spring element 24.

According to still further aspects of the swivelable single axle truck of this invention, a brake assembly 124 is mounted by the lower inboard end of radius arm 18. As illustrated in FIG. 2, this assembly includes an open ended mounting channel 126 that opens at one end opposite the wheel flange. A brake member 128 is movable within this channel by an appropriate actuater not shown so as to apply braking effort to the wheel tread. An elastomerically damped adaptor assembly 130 supports axle 20 from the outboard end of radius arm 18. Further details of these and other aspects of the suspension, brake or adaptor assemblies are illustrated and described in the aforesaid U.S. Pat. No. 4,356,775.

Although one presently preferred embodiment of the present invention has been illustrated and described herein, variations will become apparent to one of ordinary skill in the art. Accordingly, the invention is not to be limited to the specific embodiment illustrated and described herein, and the true scope and spirit of the invention are to be determined by reference to the appended claims.

The embodiments of the invention in which an exclusive property or privelege is claimed are defined as follows.

1. A yaw damper for a swivelable railcar truck, comprising: means movable conjointly with the truck forming two opposed surfaces extending in parallel alignment with the general direction of straight line truck travel; and yaw control means mountable by an overhead railcar body compressively gripping said two surfaces so as to apply a frictional damping force to at least one of said surfaces as said surfaces move away from said general direction when the truck negotiates curved track.

2. The damper of claim 1, wherein said yaw control means include means forming a low friction surface in face-to-face sliding contact with the other of said surfaces.

3. The damper of claim 2, wherein said yaw control means include yaw damping means engaging and supporting said one surface.

4. The damper of claim 3, wherein said frictional damping force remains substantially constant.

5. The damper of claim 3, wherein said frictional damping force is proportional to load.

6. A yaw damper for a swivelable railcar truck, comprising: means mountable by an overhead railcar body forming a low friction surface; an elongated member movable conjointly with a railcar truck, and having two opposed surfaces, one of which is in face-to-face contact with said low friction surface; and yaw control means mountable by said railcar body for applying a frictional damping force to the other surface of said member when the truck negotiates curved track.

7. The damper of claim 6, wherein said yaw control means include support means underlying and generally transverse to said other surface, and spring means supported by said support means in underlying load bearing relation with said other surface.

8. The damper of claim 7, wherein said support means include a channel member mountable at its ends to said railcar body with its midsection spaced from and in generally transverse relation to said other surface, said spring means acting between said other surface and said midsection to provide said frictional damping force.

9. The damper of claim 7, wherein said spring means comprise an elastomeric shear/compression spring providing a first force that opposes a second force applied by said railcar body such that said frictional damping force is proportional to the resultant of said first force and said second force, said spring being so constructed and arranged that said spring is deflected in shear and simultaneously reduced in thickness in response to movement of said other surface when the truck negotiates curved track, said reduction in thickness causing a reduction in said first force sufficient to offset an increase in said second force such that said frictional damping force remains substantially constant.

10. The damper of claim 7, wherein said spring means comprise an elastomeric compression spring and means interposed between said spring and said other surface for causing said spring to remain essentially only in compression in response to movement of said other surface when the truck negotiates curved track.

11. The damper of claim 10, wherein said means interposed between said spring and said other surface include a plate member free to shift with respect to said other surface.

12. The damper of claim 11, wherein said plate includes a low friction surface in face-to-face contact with said other surface, and said support means include means retaining said spring in position.

* * * * *